US008126385B2

(12) United States Patent
Arai et al.

(10) Patent No.: US 8,126,385 B2
(45) Date of Patent: Feb. 28, 2012

(54) IMAGE FORMING MECHANISM AND IMAGE FORMING DEVICE

(75) Inventors: Kazuhiko Arai, Kanagawa (JP); Nobuyuki Nakayama, Kanagawa (JP); Daisuke Nagao, Kanagawa (JP); Ryosuke Takahashi, Kanagawa (JP); Yasuhiro Oda, Kanagawa (JP); Koichiro Yuasa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 404 days.

(21) Appl. No.: 12/558,680

(22) Filed: Sep. 14, 2009

(65) Prior Publication Data

US 2010/0202813 A1 Aug. 12, 2010

(30) Foreign Application Priority Data

Feb. 6, 2009 (JP) ..... 2009-026250

(51) Int. Cl.
*G03G 21/00* (2006.01)

(52) U.S. Cl. ..... 399/350; 399/116; 399/159

(58) Field of Classification Search ..... 399/116, 399/159, 350

See application file for complete search history.

(56) References Cited

U.S. PATENT DOCUMENTS

| | | | | |
|---|---|---|---|---|
| 2006/0045571 | A1* | 3/2006 | Matsuura et al. | 399/149 |
| 2007/0059039 | A1* | 3/2007 | Shimoyama et al. | 399/159 |
| 2008/0080914 | A1* | 4/2008 | Sugimoto | 399/350 |
| 2009/0003905 | A1* | 1/2009 | Ueno et al. | 399/350 |
| 2009/0311017 | A1* | 12/2009 | Ohmori et al. | 399/350 |
| 2010/0247148 | A1* | 9/2010 | Haruyama et al. | 399/159 |

FOREIGN PATENT DOCUMENTS

| | | |
|---|---|---|
| JP | 2000-305311 | 11/2000 |
| JP | 2001-305773 | 11/2001 |
| JP | 2002-214989 | 7/2002 |
| JP | 2005-025162 | 1/2005 |

* cited by examiner

*Primary Examiner* — David Gray
*Assistant Examiner* — G. M. Hyder
(74) *Attorney, Agent, or Firm* — Fildes & Outland, P.C.

(57) ABSTRACT

There is provided an image forming mechanism including: an image carrier containing a lubricant in a photosensitive layer that is formed on a surface of the image carrier, and on which an electrostatic latent image is formed; a developing section developing the electrostatic latent image into a visible image by a developer that contains the lubricant; and a cleaning member formed with a first layer that contacts the photosensitive layer, and a second layer that is formed of a material having a lower modulus of repulsion elasticity than the first layer and that is layered with the first layer and that does not contact the surface of the image carrier.

10 Claims, 11 Drawing Sheets

FIG.7

| | OBVERSE LAYER (PHOTORECEPTOR SIDE) | | | | REVERSE LAYER (SIDE OPPOSITE PHOTORECEPTOR SIDE) | | | | SET CONDITIONS | | |
|---|---|---|---|---|---|---|---|---|---|---|---|
| | THICKNESS (mm) | YOUNG'S MODULUS (MPa) | MODULUS OF REPULSION ELASTICITY (%) | DENSITY (g/cm$^3$) | THICKNESS (mm) | YOUNG'S MODULUS (MPa) | MODULUS OF REPULSION ELASTICITY (%) | DENSITY (g/cm$^3$) | BITE-IN AMOUNT (mm) | NF (gf/mm) | WA (° ) |
| COMPARATIVE EXAMPLE 1 (SINGLE LAYER) | 1.9 | 10.1 | 43 | 1.14 | – | – | – | – | 0.75 | 2.8 | 12 |
| COMPARATIVE EXAMPLE 2 (SINGLE LAYER) | 1.9 | 6.4 | 43 | 1.14 | – | – | – | – | 1.14 | | |
| PATTERN 1 (TWO LAYER) | 0.4 | 10.1 | 43 | 1.14 | 1.54 | 4.6 | 33 | 1.14 | 0.96 | 2.8 | 12 |
| PATTERN 2 (TWO LAYER) | | | | | 1.40 | | | | 1.14 | | |
| PATTERN 3 (TWO LAYER) | | | | | 1.26 | | | | 1.36 | | |
| PATTERN 4 (TWO LAYER) | | | | | 1.4 | 5.5 | | | 1.03 | | |
| PATTERN 5 (TWO LAYER) | | | | | | 3.7 | | | 1.28 | | |
| PATTERN 6 (TWO LAYER) | | | | | | 4.6 | 40 | | 1.14 | | |
| PATTERN 7 (TWO LAYER) | | | | | | | 26 | | 1.14 | | |
| PATTERN 8 (TWO LAYER) | | | | | | | 33 | 1.37 | 1.14 | | |
| PATTERN 9 (TWO LAYER) | | | | | | | | 0.91 | 1.14 | | |

COMPARATIVE EXAMPLE 1

COMPARATIVE EXAMPLE 2

PATTERN 1

PATTERN 4

FIG.13A

| | | TONER PTFE AMOUNT (wt%) | | | | | |
|---|---|---|---|---|---|---|---|
| | | 0 | 0.05 | 0.1 | 0.2 | 0.4 | 0.4~ |
| PHOTORECEPTOR PTFE AMOUNT (wt%) | 0 | ○ | ○ | ○ | ○ | ○ | ○ |
| | 2 | ○ | ○ | ○ | ○ | ○ | ○ |
| | 4 | ○ | ○ | ○ | ○ | ○ | ○ |
| | 8 | ○ | ○ | ○ | ○ | ○ | ○ |
| | 12 | ○ | ○ | ○ | ○ | ○ | △ |
| | 12~ | ○ | ○ | ○ | ○ | △ | × |

FIG.13B

| | | TONER PTFE AMOUNT (wt%) | | | | | |
|---|---|---|---|---|---|---|---|
| | | 0 | 0.05 | 0.1 | 0.2 | 0.4 | 0.4~ |
| PHOTORECEPTOR PTFE AMOUNT (wt%) | 0 | ○ | ○ | ○ | ○ | ○ | × |
| | 2 | ○ | △ | △ | × | × | × |
| | 4 | ○ | △ | × | × | × | × |
| | 8 | ○ | △ | × | × | × | × |
| | 12 | ○ | △ | × | × | × | × |
| | 12~ | × | × | × | × | × | × |

IN-PLANE DIFFERENCE OF PHOTORECEPTOR WEAR AT THE POINT IN TIME OF 100 kcyc

○ 0~2(μm)

△ 2~4(μm)

× 4~ (μm)

IMAGE FORMING MECHANISM AND IMAGE FORMING DEVICE

CROSS-REFERENCE TO RELATED APPLICATION

This application claims priority under 35 USC 119 from Japanese Patent Application No. 2009-026250 filed on Feb. 6, 2009.

BACKGROUND

1. Technical Field

The present invention relates to an image forming mechanism and an image forming device.

2. Related Art

Conventionally, there are structures that add a lubricant to the surface layer of a photoreceptor so as to reduce wear of the photoreceptor. Further, there are structures that add a lubricant to a developer so as to reduce wear of a photoreceptor.

Moreover, there are structures that provide a toner pool so as to aim for increased lifespan of a cleaning blade. Or, there are structures that make a cleaning blade be a two-layer structure.

SUMMARY

An aspect of the present invention provides an image forming mechanism including:

an image carrier containing a lubricant in a photosensitive layer that is formed on a surface of the image carrier, and on which an electrostatic latent image is formed;

a developing section developing the electrostatic latent image into a visible image by a developer that contains the lubricant; and a cleaning member formed with a first layer that contacts the photosensitive layer, and a second layer that is formed of a material having a lower modulus of repulsion elasticity than the first layer and that is layered with the first layer and that does not contact the surface of the image carrier.

BRIEF DESCRIPTION OF THE DRAWINGS

An exemplary embodiment of the present invention will be described in detail based on the following figures, wherein:

FIG. 7 is a table showing properties of materials forming a cleaning blade relating to the exemplary embodiment of the present invention;

FIG. 13A and FIG. 13B are graphs showing amounts of irregular wear at the surfaces of photoreceptor drums of the cleaning blade relating to the exemplary embodiment of the present invention and a conventional example.

DETAILED DESCRIPTION

An exemplary embodiment of the present invention will be described hereinafter with reference to the drawings.

<Structure>

Figure 1:
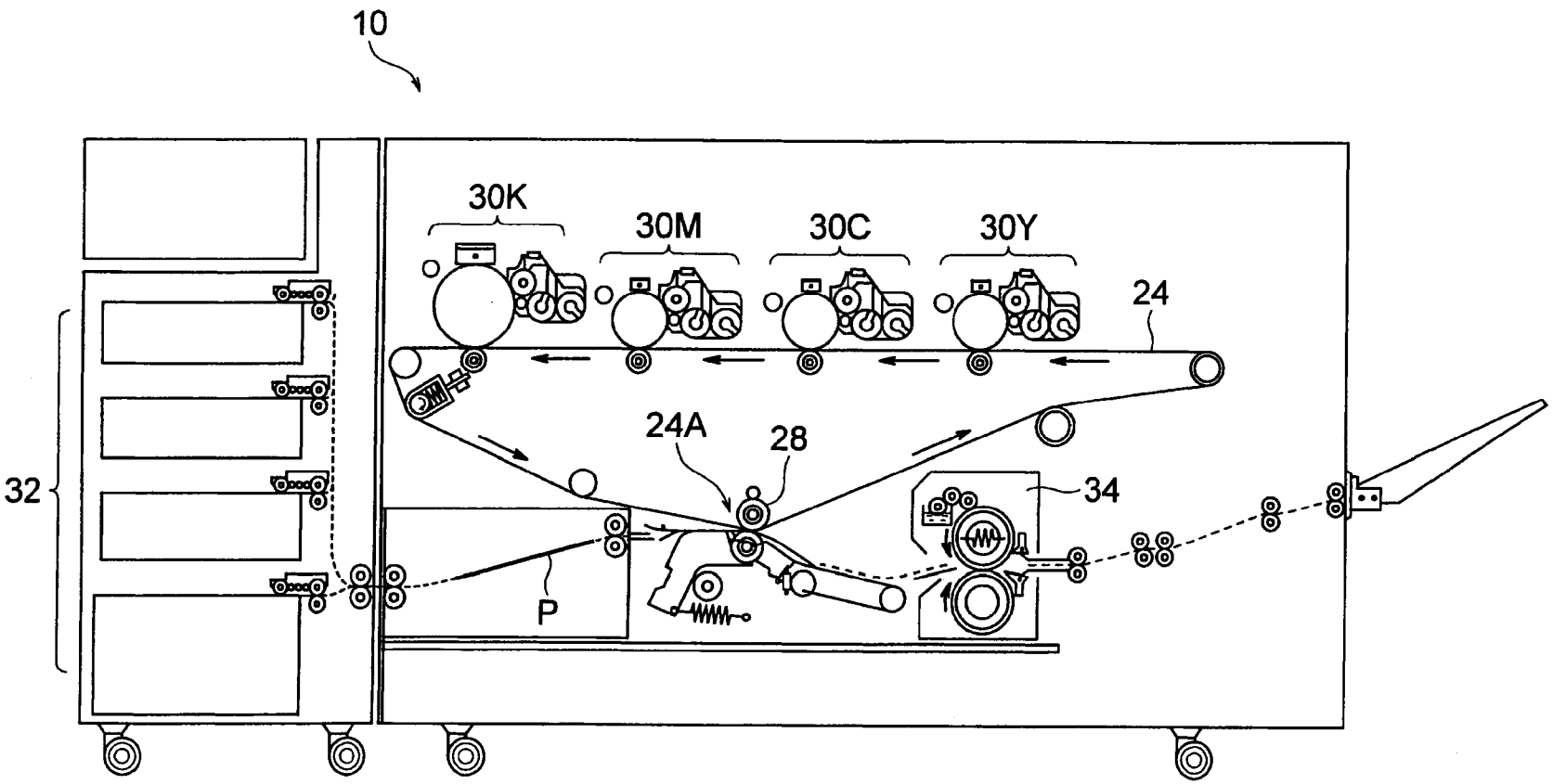
FIG. 1 is a cross-sectional view showing the structure of an image forming device equipped with an image forming mechanism relating to an exemplary embodiment of the present invention.
Figure 2:
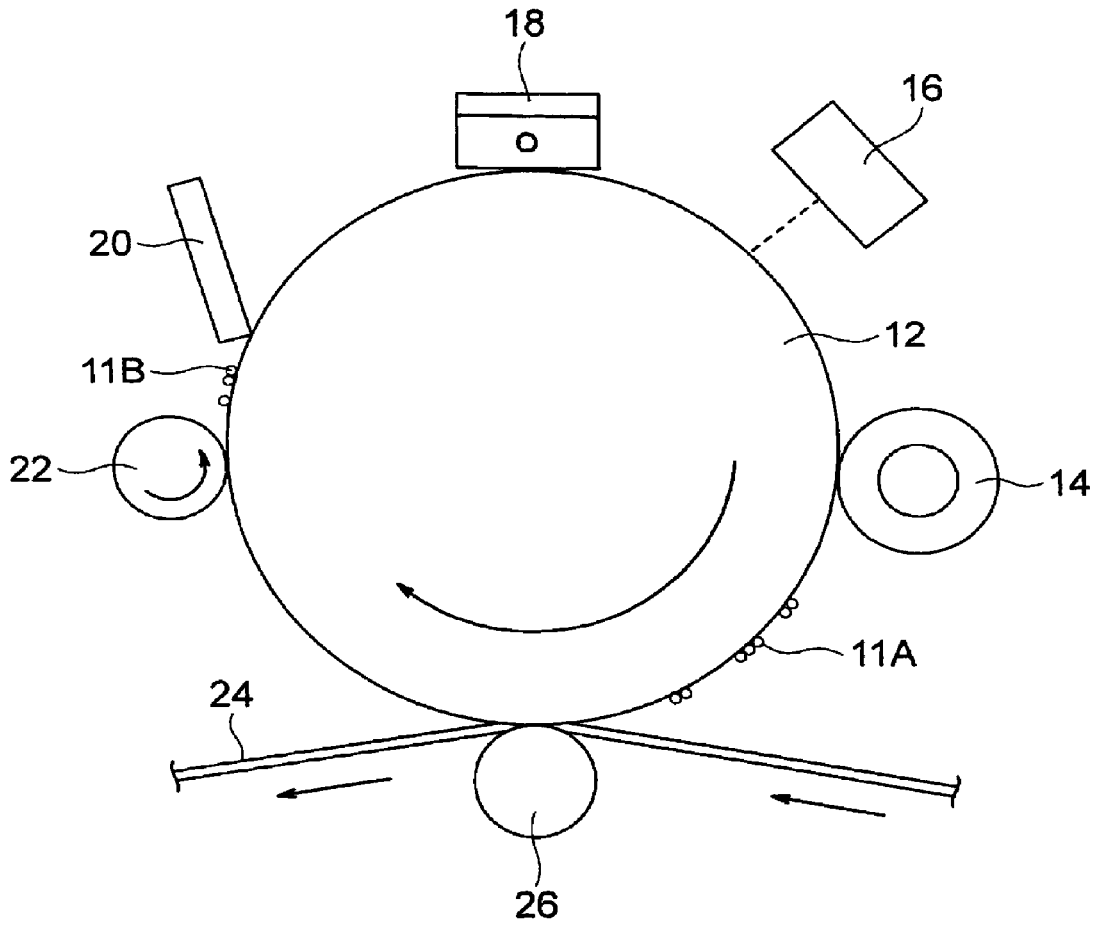
FIG. 2 is a side view showing the structure of the image forming mechanism shown in FIG. 1.

FIG. 1 and FIG. 2 are cross-sectional views showing the internal structure of an image forming device relating to the exemplary embodiment of the present invention.

As shown in FIG. 1, an image forming device 10 has an intermediate transfer belt 24 on whose surface toner images are transferred, and image forming mechanisms 30Y through 30K that form the toner images on the surface of the intermediate transfer belt 24. The main portion of the image forming device 10 is structured thereby.

Each of the image forming mechanisms 30Y through 30K is structured from a photoreceptor drum 12 on whose surface and electrostatic latent image is formed, a charging device 18 for primary charging that contacts and charges the photoreceptor drum 12, a light scanning device 16 that forms an electrostatic latent image on the photoreceptor drum 12, and a developing unit 14 that develops the electrostatic latent image by toner. The respective color toners that are consumed in the image formation are replenished by toners 11 of respective colors being supplied from unillustrated toner cartridges to the developing units 14Y through 14K.

The toner image that is formed on the photoreceptor drum 12 is transferred from the surface of the photoreceptor drum 12 onto the intermediate transfer belt 24 at a nip position between a primary transfer roller 26 that is provided at a position opposing the photoreceptor drum 12 with the intermediate transfer belt 24 nipped therebetween, and the intermediate transfer belt 24 that is driven in the direction of the arrows in the drawing while abutting the photoreceptor drum 12 that rotates.

Recording sheets P that are accommodated in a tray 32 are conveyed along a sheet conveying path, and, at a nip position 24A, are pressed tightly against the intermediate transfer belt 24 that is pressed by a secondary transfer roller 28. The toner images, that were transferred onto the intermediate transfer belt 24 from the photoreceptor drums 12, are transferred onto the recording sheet P.

The recording sheet P, on whose surface the toner image has been transferred, is conveyed along the conveying path and passes through a fixing device 34 where the heat-fused toner image is fixed. The recording sheet P on which the image is formed is discharged to the exterior of the device and outputted as an image.

The internal structure of the periphery of the photoreceptor drum of the image forming device relating to the exemplary embodiment of the present invention is shown in FIG. 2.

As shown in FIG. 2, after surface potential is applied to the photoreceptor drum 12 at the charging device 18, scanning exposure is provided by the light scanning device 16. Due to potential being lost only at the exposed portions, an electrostatic latent image is formed on the surface of the photoreceptor drum 12. Due to the toner 11 being supplied to the non-exposed portions by the developing unit 14, the electrostatic latent image is developed by the toner, and is formed on the surface of the photoreceptor drum 12 as a toner image 11A that is formed from the toner 11 of that color.

The toner image is transferred by nip pressure and transfer potential onto the intermediate transfer belt 24 that is nipped by the photoreceptor drum 12 at the primary transfer roller 26. The toner images that are transferred onto the intermediate transfer belt 24 are transferred so as to be superposed at the same position for each color of YMCK, and finally, the toner images of the four colors are superposed at a correctly aligned position and transferred onto the recording sheet P.

After the toner image 11A that is formed on the surface of the photoreceptor drum 11A is transferred onto the intermediate transfer belt 24, residual toner 11B that was not transferred onto the intermediate transfer belt 24 remains on the surface of the photoreceptor drum 12. As shown in FIG. 2, the residual toner 11B is scraped-off by a cleaning blade 20 and removed from the surface of the photoreceptor drum 12.

Figure 4:
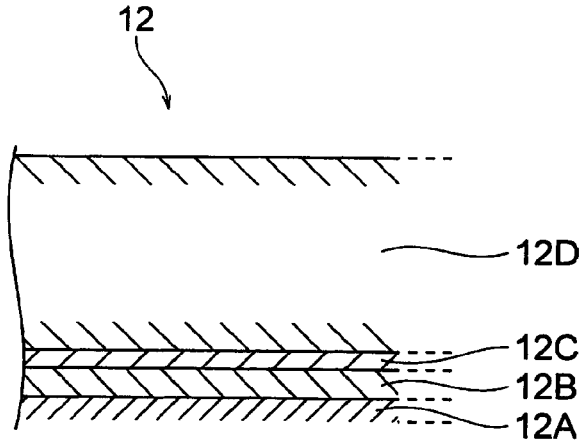
FIG. 4 is a cross-sectional view showing the surface structure of a photoreceptor drum relating to the exemplary embodiment of the present invention.

The surface structure of the photoreceptor drum 12 is shown in FIG. 4. The photoreceptor drum 12 is a structure at which a undercoat layer 12B, a charge generating layer 12C and a charge transport layer 12D are formed on an aluminum substrate 12A.

Figure 5:
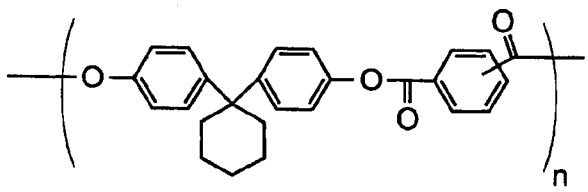
FIG. 5 is a structural formula showing the structure of a polymer compound that is a material of a charge transport layer of the photoreceptor drum relating to the exemplary embodiment of the present invention.
Figure 6:
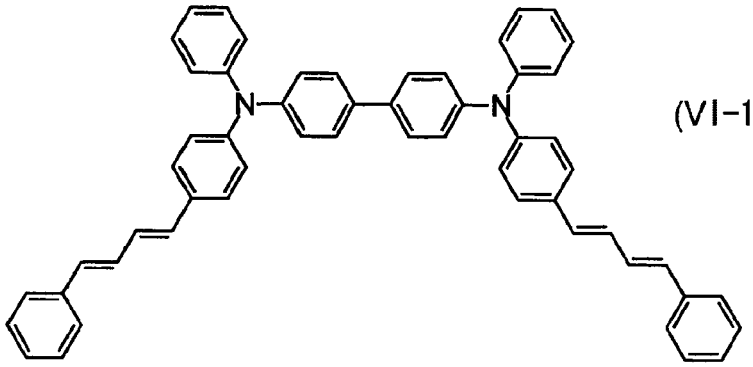
FIG. 6 is a structural formula showing the structure of a charge transport material that is a material of the charge transport layer of the photoreceptor drum relating to the exemplary embodiment of the present invention.

Specifically, the cylindrical aluminum substrate 12A of an outer diameter of Φ30 mm that has been subjected to honing processing is readied. A coating liquid for undercoat layer formation is coated on the aluminum substrate 12A by dipping, and the undercoat layer 12B is formed by heating and drying. Next, a coating liquid for charge generating layer formation is coated on the undercoat layer 12B by dipping, and is heated and dried such that the charge generating layer 12C is formed. Next, a coating liquid for the charge transport layer is obtained by adding and dispersing polytetrafluoroethylene particulates Ruburon L2 (Daikin Industries, Ltd.) to and in a liquid that is obtained by mixing together the charge transport material shown by formula (VI-1) of FIG. 6, a polymer compound having the structural unit shown by (VI-2) of FIG. 5, and chlorobenzene. This coating liquid for the charge transport layer is coated on the charge generating layer 12C and heated so as to form the charge transport layer 12D.

The photoreceptor drum 12, at which the undercoat layer 12B, the charge generating layer 12C and the charge transport layer 12D that contains polytetrafluoroethylene (hereinafter, referred to as PTFE) as described above are formed on the aluminum substrate 12A that has been subjected to honing processing, is obtained as described above.

Figure 3B:
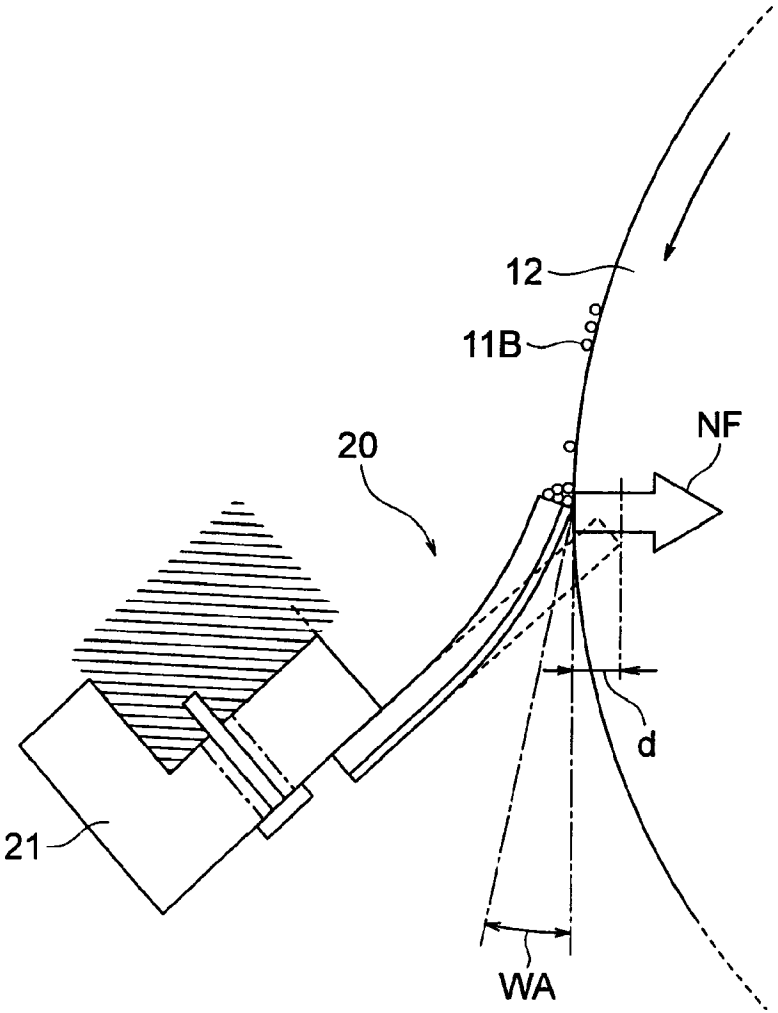
FIG. 3A and FIG. 3B are side views showing, in an enlarged manner, the structure of the image forming mechanism shown in FIG. 2.
Figure 3A:
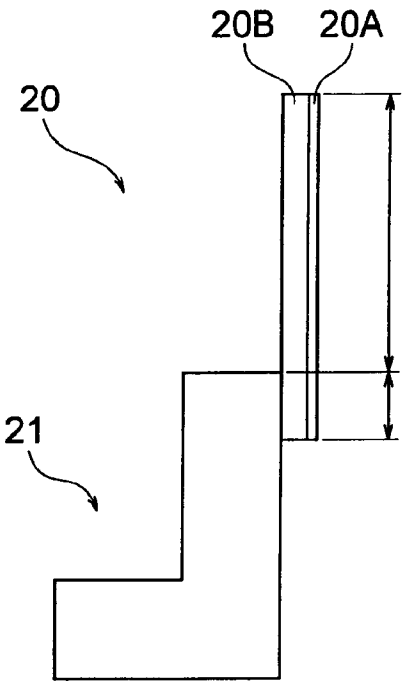

The structure at the periphery of the cleaning blade of the image forming device relating to the exemplary embodiment of the present invention is shown in FIG. 3A and FIG. 3B.

As shown in FIG. 3A and FIG. 3B, the cleaning blade 20 is a two-layer structure. An obverse layer 20A that contacts the surface of the photoreceptor drum 12 is formed of a material that, as compared with a reverse layer 20B that does not contact the surface of the photoreceptor drum 12, has a low Young's modulus and damping coefficient, high hardness and low repulsion. The cleaning blade 20 is a slender plate-shaped member. As shown in FIG. 3A, the region from one transverse direction end to part-way along (Lb in the drawing) is fixed to a holding member 21, such that La that is the free end side is supported so as to be deformable by its own elasticity. La:Lb is approximately 2:1.

As shown in FIG. 3B, plural places in the longitudinal direction of the holding member 21, that holds the cleaning blade 20, are fixed by fixing screws 21A to a frame 23. The cleaning blade 20 that is held at the holding member 21 is pressed against the surface of the photoreceptor drum 12 at pressing force NF, and deforms by bite-in amount d. Due thereto, the obverse layer 20A of the cleaning blade 20 contacts the surface of the photoreceptor drum 12 at angle WA. The residual toner 11B adhering to the surface of the photoreceptor drum 12 is scraped-off by the obverse layer 20A of the cleaning blade 20.

In the same way as the charge transport layer 12D of the photoreceptor 12, PTFE is contained in the toner 11. Specifically, silica particles of an average particle diameter of 12 nm, silica particles of an average particle diameter of 40 nm, and Ruburon L2 (Daikin Industries, Ltd.) composed of PTFE particles are added to toner cohered particles, and are mixed-together in a Henschel mixer so as to prepare the toner 11. Due thereto, the toner 11, that is in a state in which the PTFE particles adhere in a range of a particle diameter of 0.2 to 1 μm to the toner cohered particles, is obtained.

The effects that combinations of structures and properties of materials of the cleaning blade of the image forming device relating to the exemplary embodiment of the present invention, have on the surface of the photoreceptor drum 12 are shown in FIG. 7 through FIG. 13.

Figure 11A:
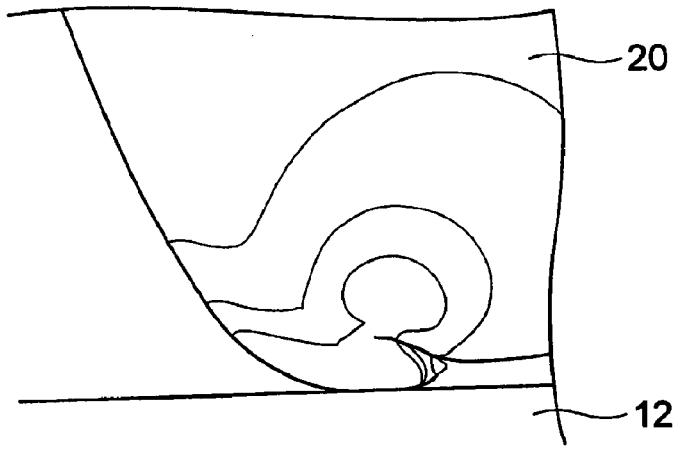
FIG. 11A through FIG. 11C are drawings showing, per coefficient of friction, deformation at the surface of the photoreceptor drum, of the cleaning blade relating to the exemplary embodiment of the present invention.
Figure 11B:
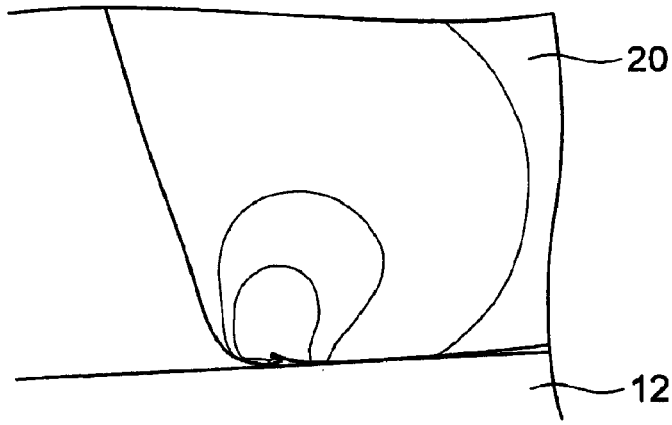
Figure 11C:
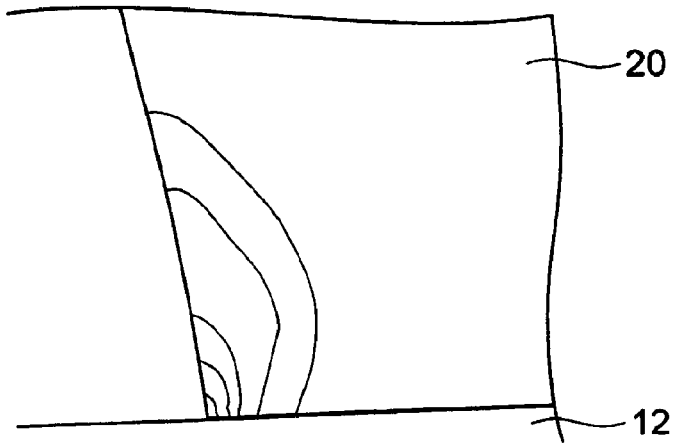

The state of the distal end of the cleaning blade 20 when the coefficient of friction of the cleaning blade 20 and the surface of the photoreceptor drum 12 is large is shown in FIG. 11A, and when the coefficient of friction is small is shown in FIG. 11B, and when the coefficient of friction is small and the pressing force NF is substantially 0 is shown in FIG. 11C. In the state shown in FIG. 11C, the longitudinal direction both end portions of the surface of the photoreceptor drum 12 are worn more than the central portion as shown in FIG. 11A and FIG. 11B.

Figure 8:
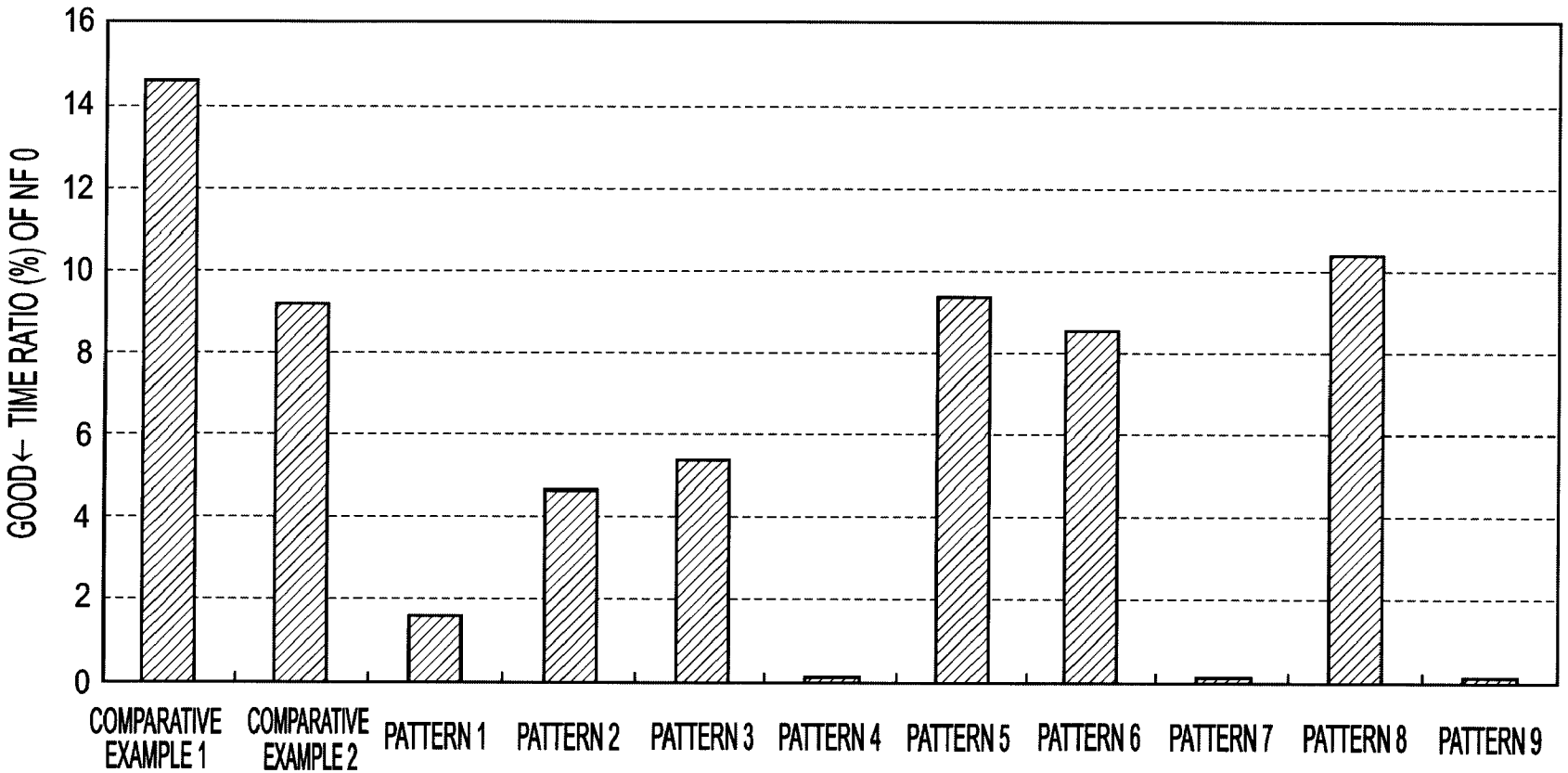
FIG. 8 is a graph showing the proportion of the time that the pressing force is 0 of the cleaning blade relating to the exemplary embodiment of the present invention and comparative examples.

With examples of combinations of patterns that change in various ways the size and, as properties, the thickness, Young's modulus, modulus of repulsion elasticity, and density of the reverse layer 20B when the cleaning blade 20 is made to be two layer structure as compared with two types of conventional examples that have a cleaning blade of a single-layer structure as shown in FIG. 7, the results shown in FIG. 8 are obtained that, with pattern 4, pattern 7 and pattern 9, the time that the pressing force NF is substantially 0 is shorter than the conventional examples. It can be understood that, the longer the time that the pressing force NF is substantially 0, the easier it is for the cleaning blade 20 to be excited, and the easier it is for irregular wear to occur at the surface of the photoreceptor drum 12. Namely, as shown by the graph in FIG. 10, the time that the pressing force NF is substantially 0 and the difference in the wear amount in the longitudinal direction at the surface of the photoreceptor drum 12 are correlated.

Figure 9A:
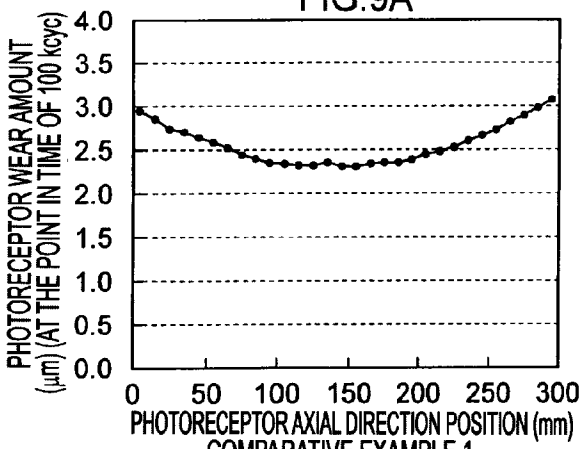
FIG. 9A through FIG. 9D are graphs showing amounts of irregular wear at the surfaces of photoreceptor drums of the cleaning blade relating to the exemplary embodiment of the present invention and comparative examples.
Figure 9B:
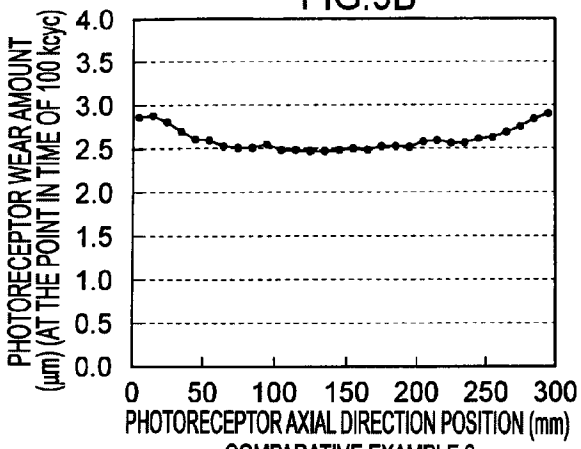
Figure 9C:
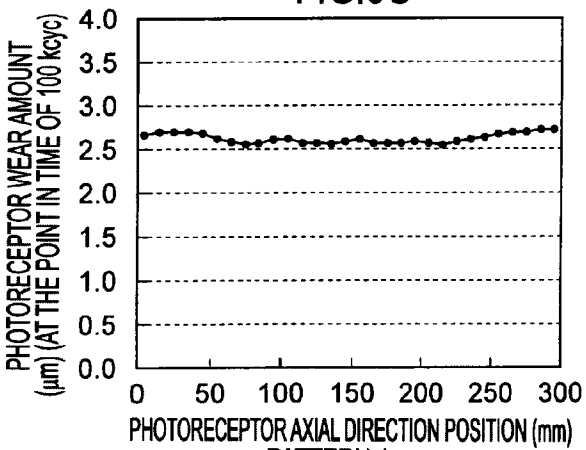
Figure 9D:
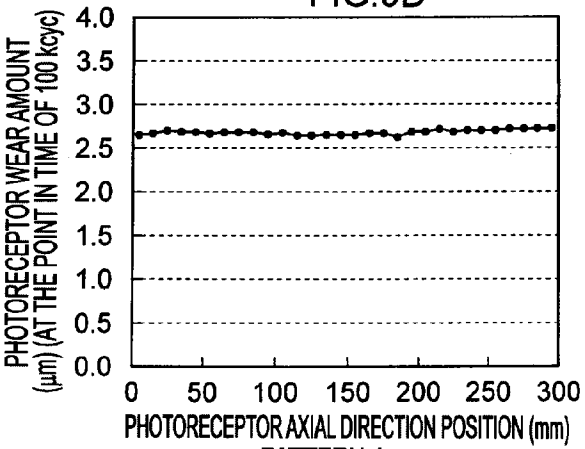
Figure 10:
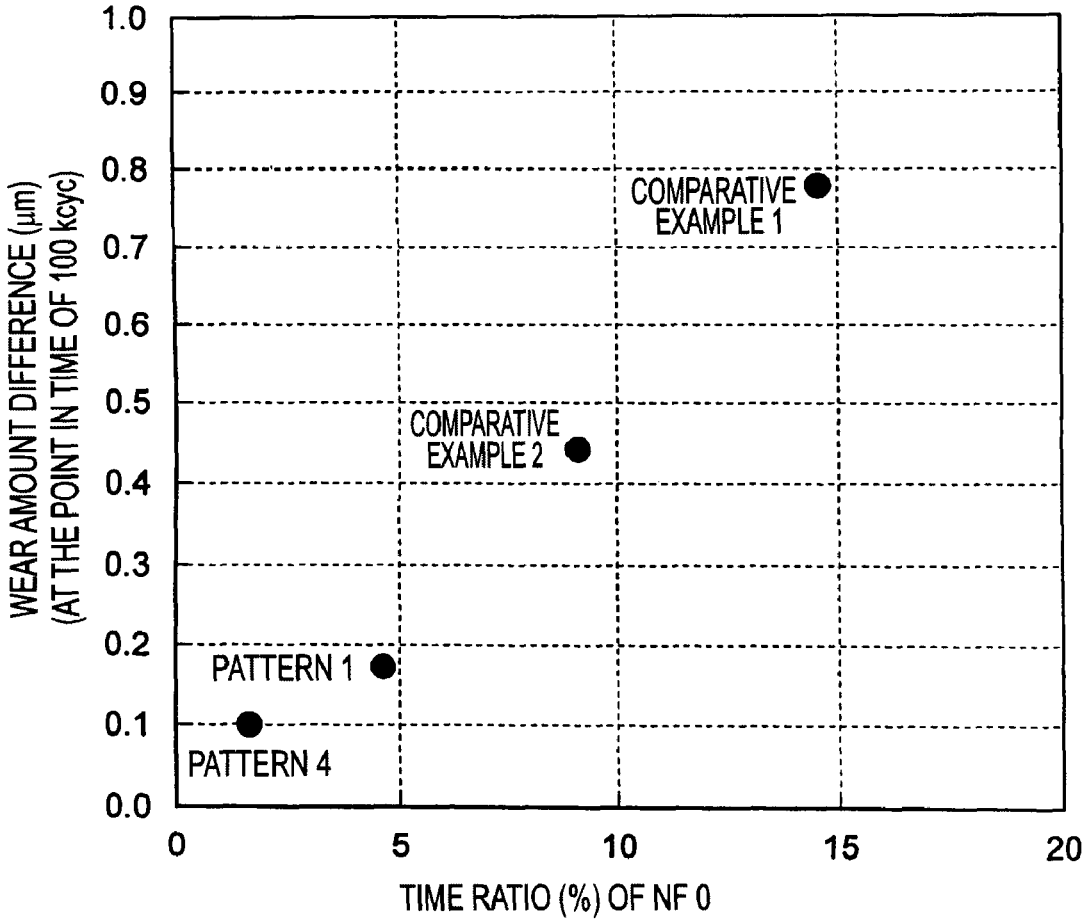
FIG. 10 is a graph showing the relationship between the proportion of the time that the pressing force is 0 and the amount of irregular wear at the surfaces of photoreceptor drums of the cleaning blade relating to the exemplary embodiment of the present invention and comparative examples.

Namely, pattern 4 is a combination in which the Young's modulus of the reverse layer 20B is high, and pattern 7 is a combination in which the modulus of repulsion elasticity of the reverse layer 20B is low, and pattern 9 is a combination in which the density of the reverse layer 20B is low. In accordance with these combinations, as compared with the conventional examples shown in FIG. 9A and FIG. 9B, results are obtained that there is little occurrence of irregular wear in the longitudinal direction at the surface of the photoreceptor drum 12, as shown in FIG. 9C and FIG. 9D.

Figure 12:
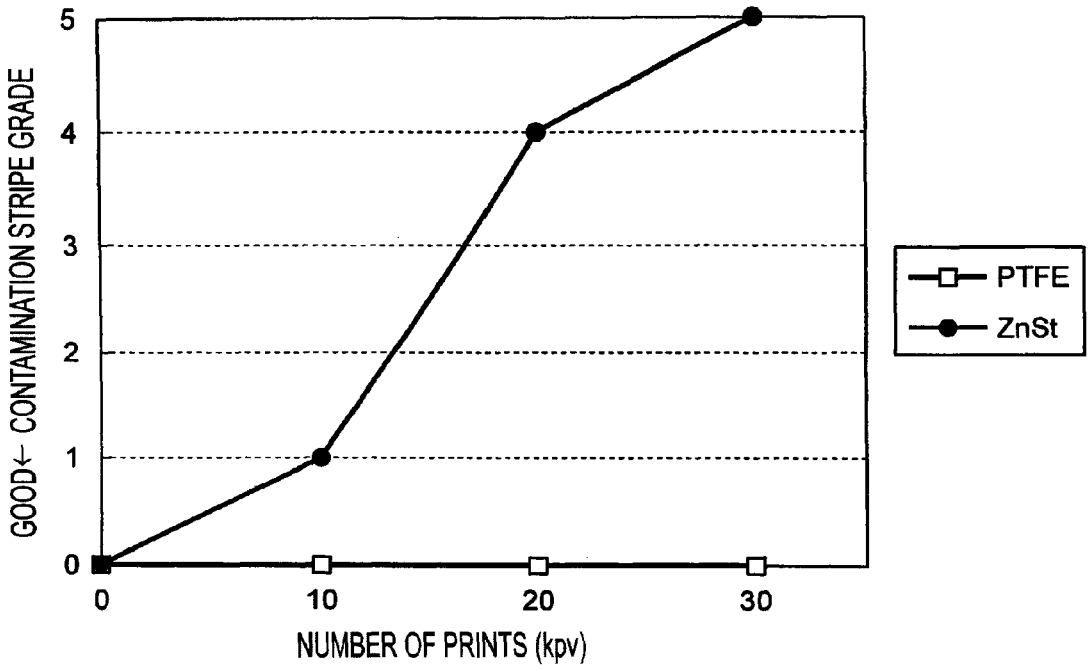
FIG. 12 is a graph showing differences in occurrence at a charger of stripes due to contamination, when PTFE and ZnSt are used in a lubricant that is contained in the developer and the surface of the photoreceptor drum relating to the exemplary embodiment of the present invention.

The amount of occurrence at the charging device 18 of stripes due to contamination, per number of prints, is shown in FIG. 12 by comparing two types of lubricants. As shown in FIG. 12, results are obtained that, as compared with the example using zinc stearate (ZnSt) in the lubricant contained in the charge transport layer 12D of the photoreceptor drum 12 and the toner 11, it is difficult for stripes due to contamination to arise at the charging device 18 in the example using PTFE in the lubricant.

Differences in the irregular wear amount at the surface of the photoreceptor drum 12 after processing 100,000 sheets is shown in FIG. 13A and FIG. 13B by comparing pattern 4 of the present exemplary embodiment shown in FIG. 7 and a conventional example. As shown in FIG. 13A and FIG. 13B, the results are obtained that, when the amount of the lubricant PTFE that is contained in the charge transport layer 12D of the photoreceptor drum 12 and the toner 11 is increased, the irregular wear at the surface of the photoreceptor drum 12 increases in the comparative example, whereas, in the present exemplary embodiment, even if the amount of the lubricant PTFE is increased, it is difficult for irregular wear at the surface of the photoreceptor drum 12 to increase.

<Others>

An exemplary embodiment of the present invention has been described above, but the present invention is not limited in any way to the above-described exemplary embodiment, and can of course be implemented by various aspects within a range that does not deviate from the gist of the present invention.

For example, in the above-described exemplary embodiment, the cleaning blade that removes the residual toner from the surface of the photoreceptor drum is given as an example, but the present invention is not limited to the same and can be applied to, for example, a cleaner such as a belt, a roller, or the like.

What is claimed is:

1. An image forming mechanism comprising:

an image carrier containing a lubricant in a photosensitive layer that is formed on a surface of the image carrier, and on which an electrostatic latent image is formed;

a developing section developing the electrostatic latent image into a visible image by a developer that contains the lubricant; and a cleaning member formed with a first layer that contacts the photosensitive layer, and a second layer that is formed of a material having a lower modulus of repulsion elasticity than the first layer and that is layered with the first layer and that does not contact the surface of the image carrier.

2. The image forming mechanism of claim 1, wherein the first layer of the cleaning member has a higher Young's modulus than the second layer.

3. The image forming mechanism of claim 2, wherein the first layer of the cleaning member has a higher density than the second layer.

4. The image forming mechanism of claim 1, wherein the first layer of the cleaning member has a higher density than the second layer.

5. The image forming mechanism of claim 1, wherein the lubricant is PTFE.

6. An image forming device comprising an image forming mechanism that has:

an image carrier containing a lubricant in a photosensitive layer that is formed on a surface of the image carrier, and on which an electrostatic latent image is formed;

a developing section developing the electrostatic latent image into a visible image by a developer that contains the lubricant; and a cleaning member formed with a first layer that contacts the photosensitive layer, and a second layer that is formed of a material having a lower modulus of repulsion elasticity than the first layer and that is layered with the first layer and that does not contact the surface of the image carrier, wherein the visible image that is developed at the developing section is transferred onto a recording medium, and is fixed at a fixing device, and is discharged.

7. The image forming device of claim 6, wherein the first layer of the cleaning member has a higher Young's modulus than the second layer.

8. The image forming device of claim 7, wherein the first layer of the cleaning member has a higher density than the second layer.

9. The image forming device of claim 6, wherein the first layer of the cleaning member has a higher density than the second layer.

10. The image forming device of claim 6, wherein the lubricant is PTFE.

* * * * *